US010411336B1

(12) United States Patent
Schwartz

(10) Patent No.: US 10,411,336 B1
(45) Date of Patent: Sep. 10, 2019

(54) POLE STRUCTURE INCORPORATING WIRELESS COMMUNICATIONS EQUIPMENT

(71) Applicant: Chad Schwartz, Annandale, NJ (US)

(72) Inventor: Chad Schwartz, Annandale, NJ (US)

(73) Assignee: CCS Technologies LLC, Annandale, NJ (US)

( * ) Notice: Subject to any disclaimer, the term of this patent is extended or adjusted under 35 U.S.C. 154(b) by 50 days.

(21) Appl. No.: 15/912,214

(22) Filed: Mar. 5, 2018

(51) Int. Cl.
*H01Q 1/12* (2006.01)
*H01Q 1/44* (2006.01)
*H01Q 1/46* (2006.01)

(52) U.S. Cl.
CPC ..... *H01Q 1/44* (2013.01); *H01Q 1/12* (2013.01); *H01Q 1/46* (2013.01)

(58) Field of Classification Search
None
See application file for complete search history.

(56) References Cited

U.S. PATENT DOCUMENTS

| | | | | |
|---|---|---|---|---|
| 4,691,970 | A | 9/1987 | Neri | |
| 5,581,958 | A | 12/1996 | Cote | |
| 5,926,145 | A | 7/1999 | Honma | |
| 5,963,178 | A | 10/1999 | Jones | |
| 6,222,503 | B1 | 4/2001 | Gietema et al. | |
| 6,751,479 | B1 | 6/2004 | Knight | |
| 8,023,826 | B2 | 9/2011 | Fasshauer et al. | |
| 10,224,594 | B2 * | 3/2019 | Norrell | H01Q 1/1242 |
| 2001/0036163 | A1 | 11/2001 | Sabat, Jr. et al. | |
| 2015/0380805 | A1 | 12/2015 | Arranz | |
| 2016/0291649 | A1 | 10/2016 | Dantin | |

* cited by examiner

*Primary Examiner* — Dimary S Lopez Cruz
(74) *Attorney, Agent, or Firm* — Thomas J. Germinario

(57) ABSTRACT

A pole structure has been modified to house the antenna arrays, radios and electrical apparatus associated with a wireless node or micro-cell site. The upper part of the pole, which can be configured as a light, utility, sign or flag pole, supports for encloses the node's antenna arrays. The lower portion of the pole, having a larger diameter than the upper part, encloses a street modular lattice core structure, on which the radios are supported on removable x-frame modules for ease of maintenance with optimal air flow and heat dissipation. A rolled steel outer skin/sheath of the lower pole has multiple hinged doors to provide ready access to the lattice core and the radios.

2 Claims, 3 Drawing Sheets

POLE STRUCTURE INCORPORATING WIRELESS COMMUNICATIONS EQUIPMENT

FIELD OF INVENTION

The present invention relates generally to the field of radio frequency (RF) communications equipment, and more specifically to RF equipment used in wireless telephone communications.

BACKGROUND OF THE INVENTION

The exploding demand for wireless data services has driven a proliferation of antenna installations, which have become increasingly more difficult and expensive to locate. In response to aesthetic and cost concerns, the current trend is toward bringing the installations closer to the end users, in the form of distributed networks of wireless nodes and micro-cell sites. While it's efficient to locate such wireless nodes on existing structures, such as light and utility poles, there are several drawbacks to doing so. Conventional RF cabinets and antenna arrays are bulky and visually intrusive, particularly in residential settings. Moreover, since existing structures are not specifically designed to house RF equipment, there are problems with heat dissipation and maintenance access. A better approach is to design a dual-use structure that serves the function of a light/utility pole, for example, while furnishing a well-engineered environment for wireless RF equipment.

SUMMARY OF THE INVENTION

The present invention is a pole structure which has been modified to house the antenna arrays, radios and electrical apparatus associated with a wireless node or micro-cell site. The upper part of the pole, which can be configured as a light, utility, sign or flag pole, supports or encloses the node's antenna arrays. The lower portion of the pole, having a larger diameter than the upper part, encloses a steel modular lattice core structure, on which the radios are supported on removable x-frame modules for ease of maintenance with optimal air flow and heat dissipation.

A rolled steel outer skin/sheath of the lower pole has multiple hinged doors to provide ready access to the lattice core and the radios. The rear panel of the lattice core is a perforated steel plate which segregates the high voltage power pole wiring from the low voltage radio circuitry. Cables from the radios to the antenna arrays in the upper pole pass through the space between the lattice core and the exterior skin/sheath of the lower pole.

The following are advantages of the present invention:

- Outer skin is interchangeable to suit the local aesthetic requirements.
- Compatible with any radio remote without alteration or replacement of the pole.
- Top plate of the pole accepts either a supplied upper pole section or allows the installation of standard street light poles or reuse of existing pole that is being replaced.
- RF components such as diplexers, multiplexers, filters, etc., can be installed within the pole near the radio remotes.
- Doors open completely, allowing easy access to equipment and cabling for reduced installation and maintenance efforts and costs.
- Internal structural face frames are easily removable to facilitate replacement of radios.

- A separate utility power compartment segregates the low voltage RF components from the utility power and lighting circuits.
- Unconstricted interior space allows for better cooling of radios, improving reliability and lowering maintenance costs.
- Lightweight modular construction allows for installation of pole with basic hand tools and without heavy equipment.
- Sections can be added as needed.
- Multiple carriers can use the same pole, each with their own section.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figures 1A, 1B, 1C:
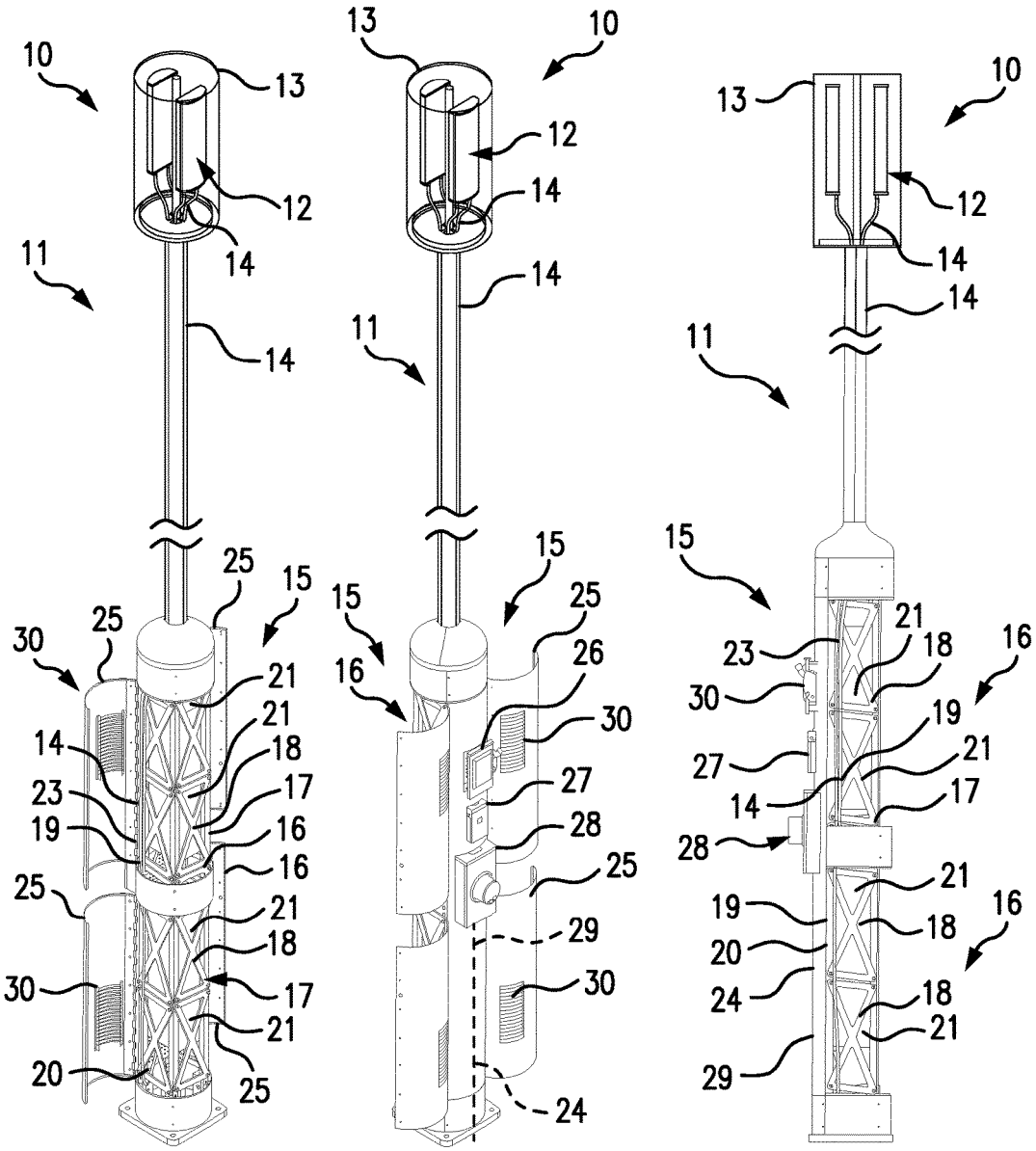
FIG. 1A is a front perspective view of the preferred embodiment of the present invention.
FIG. 1B is a rear perspective view of the preferred embodiment of the present invention.
FIG. 1C is a side profile view of the preferred embodiment of the present invention.
Figure 2A:
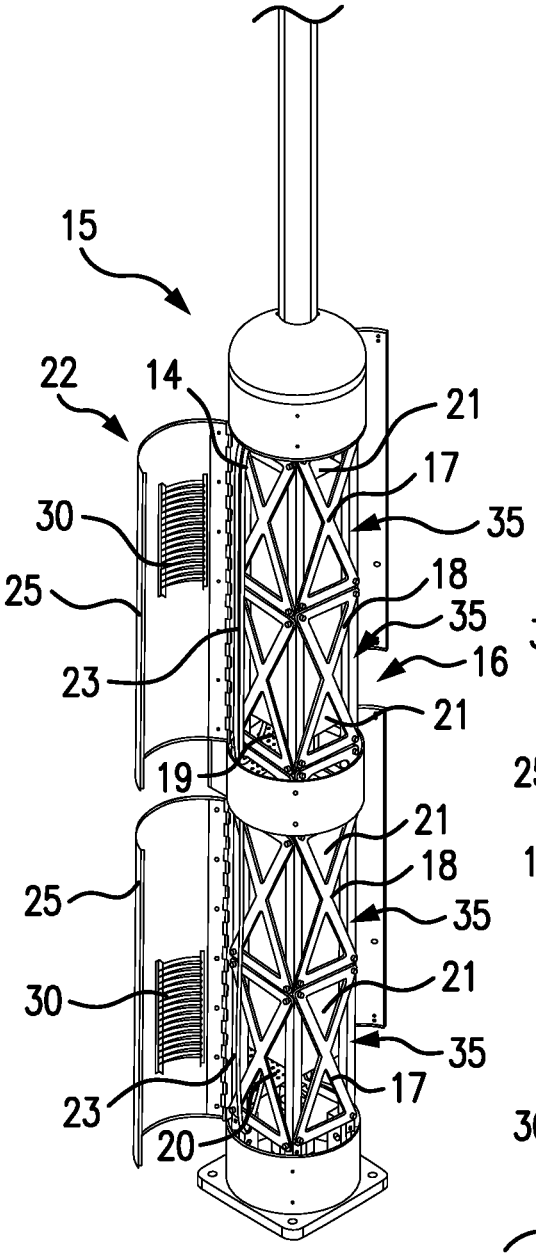
FIG. 2A is a detail front perspective view of the lower pole of the preferred embodiment of the present invention.
Figure 2B:
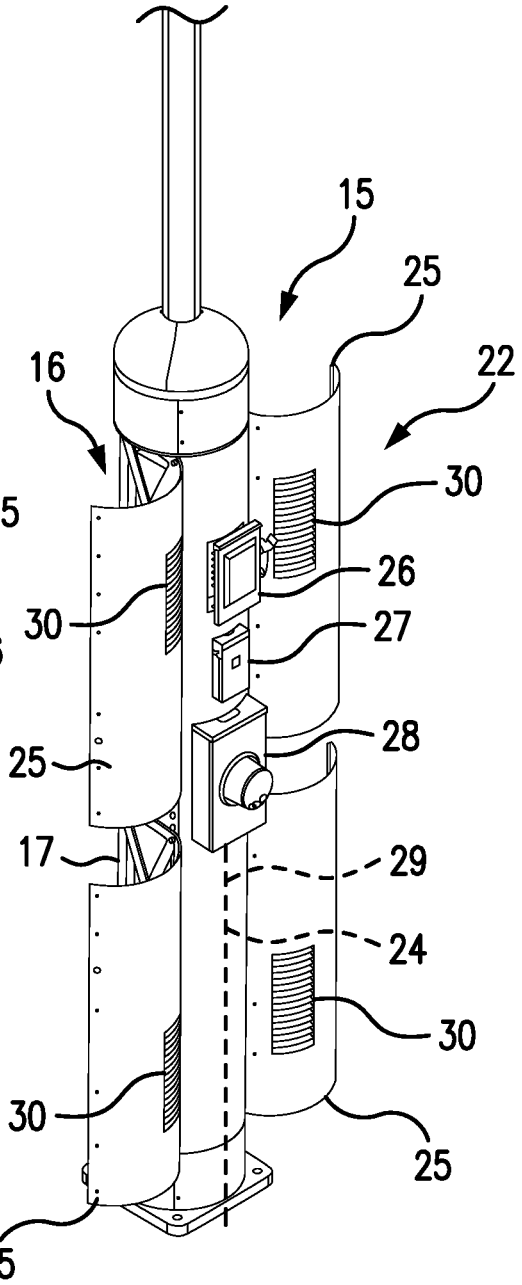
FIG. 2B is a detail rear perspective view of the lower pole of the preferred embodiment of the present invention.

Referring to FIGS. 1A-1C and FIGS. 2A-2B, the present invention 10 comprises an upper pole 11 and a lower pole 15. The upper pole 11 may be a modified conventional utility or light pole, while the lower pole 15 has a larger diameter and is designed to house wireless telephone RF equipment.

The upper pole 11 supports an antenna array 12, which is preferably enclosed in a radome 13. The antenna array 12 is electrically connected to radio units 21 in the lower pole 15 by coaxial cables 14.

The lower pole 15 comprises a modular lattice core 16, which supports multiple radio units 21 and is enclosed within a tubular exterior sheath 22. The modular lattice core 16 has an elongated rectangular cuboid shape, with three lattice faces 17 and one rear face 19. Each lattice face 17 comprises multiple removable x-shaped steel frames 18, which are longitudinally inter-connected. The rear face 19 comprises multiple perforated steel plates 20, which are longitudinally inter-connected. The core modules 35, each comprising three x-shaped steel frames 18 and one perforated steel plate 20, are removably interconnected by lug bolts or similar removable mechanical attachment means. Since each core module 35 contains one radio unit 21, radio units can readily be removed for maintenance or replaced by removing the encasing core module 35.

The coaxial cables 14 extend from the radio units 21 to the antenna array 12 through a cable corridor 23 located between the modular lattice core 16 and the exterior sheath 22. Electric power for the radio units 21 is supplied through a power corridor 24 located between the perforated steel plates 20 and the exterior sheath 22. Power input wiring 29 passes through the power corridor 24 to a power meter 25, a power disconnect panel 26 and a power distribution box 27.

The exterior sheath 22 contains multiple access doors 25, through which any of the radio units 21, and the x-frames 18 or core modules 35 containing them, can be accessed and/or removed. Ventilation for the radio units 21 is provided by louvers 30 in the access doors 25.

Figure 3C:
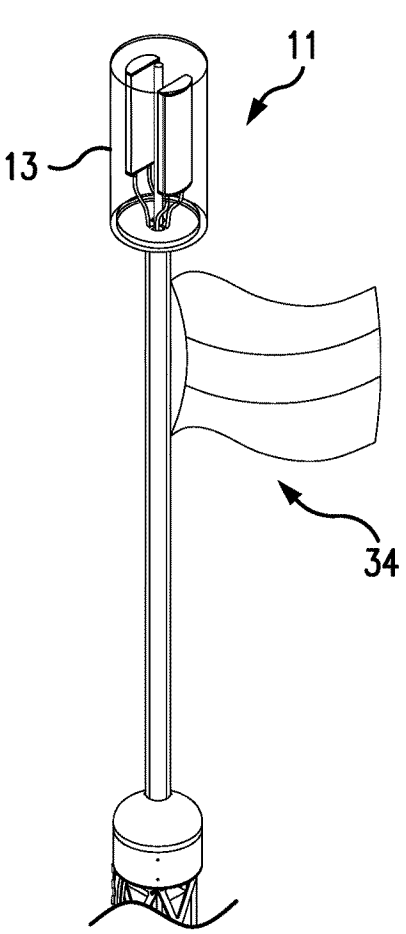
FIG. 3C is a detail perspective view of the upper pole of the preferred embodiment of the present invention with a flagpole configuration.
Figure 3B:
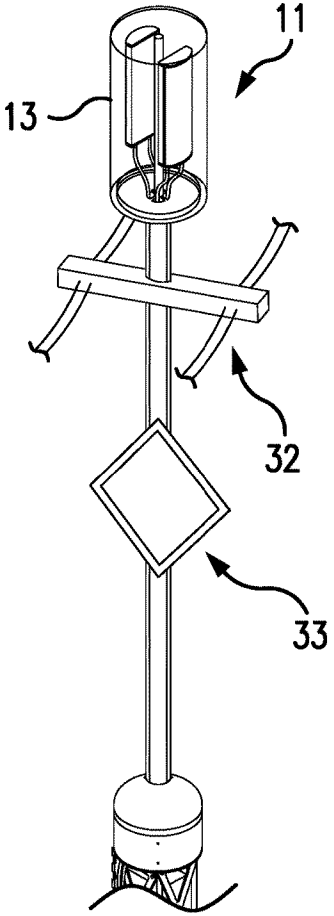
FIG. 3B is a detail perspective view of the upper pole of the preferred embodiment of the present invention with a utility pole and sign pole configuration.
Figure 3A:
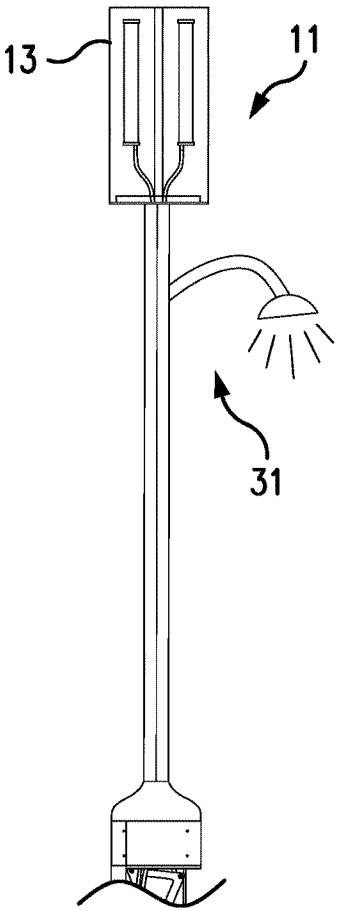
FIG. 3A is a detail side profile view of the upper pole of the preferred embodiment of the present invention with a street light configuration.

As depicted in FIGS. 3A-3C, the upper pole 11 can be configured as a street light 31, a utility pole 32, a sign pole 33 and/or a flagpole 34.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A pole structure incorporating wireless communications equipment, comprising:

a tubular upper pole supporting one or more antenna arrays;

a tubular lower pole comprising a modular lattice core supporting one or more radio units and enclosed within a substantially tubular exterior sheath;

wherein the modular lattice core has the form of an elongated rectangular cuboid, having three lattice faces, each comprising multiple removably longitudinally connected, x-shaped steel frames, and having one rear face, comprising multiple removably longitudinally connected, perforated steel plates;

wherein the modular lattice core comprises multiple rectangular cuboidal core modules, each comprising three of the x-shaped steel frames and one of the perforated steel plates, and wherein each core module contains one of the radio units, and wherein the core modules are removably interconnected;

wherein each of the radio units is supported on one of the x-shaped steel frames, and wherein electrical cables connecting each radio unit to one of the antenna arrays extend into the upper pole through a cable corridor located between the modular lattice core and the exterior sheath, and wherein electric power is supplied to each radio unit through a power corridor located between the perforated steel plates and the exterior sheath; and wherein the exterior sheath contains multiple access doors, through which the radio units and the x-shaped steel frames can be accessed and removed.

2. The pole structure according to claim 1, wherein the upper pole has a configuration selected from the group consisting of a street light, a utility pole, a sign pole, and a flagpole.

* * * * *